US007428800B1

(12) United States Patent
Vaughn et al.

(10) Patent No.: US 7,428,800 B1
(45) Date of Patent: Sep. 30, 2008

(54) IN-GROUND SHELTER

(76) Inventors: Cliffton Vaughn, P.O. Box 60554, Oklahoma City, OK (US) 73146-0554; Jerry Wirtz, P.O. Box 2586, Ponca City, OK (US) 74602

( * ) Notice: Subject to any disclaimer, the term of this patent is extended or adjusted under 35 U.S.C. 154(b) by 588 days.

(21) Appl. No.: 10/869,637

(22) Filed: Jun. 17, 2004

(51) Int. Cl.
*E02D 29/14* (2006.01)

(52) U.S. Cl. ..... 52/19; 52/20; 52/169.9

(58) Field of Classification Search ..... 52/169.9, 52/169.7, 64, 128, 19, 20, 129; 220/3.8, 220/484, 675, 672, 671, 669; 109/1 S
See application file for complete search history.

(56) References Cited

U.S. PATENT DOCUMENTS

| | | | | | |
|---|---|---|---|---|---|
| 2,653,468 | A * | 9/1953 | Rowles | 52/66 |
| 3,114,153 | A | 12/1963 | Pierson | |
| 3,118,148 | A * | 1/1964 | Taylor et al. | 52/169.6 |
| 3,173,387 | A | 3/1965 | Cree, Jr. | |
| 4,126,972 | A | 11/1978 | Silen | |
| 4,429,495 | A | 2/1984 | Aoki | |
| 5,732,512 | A * | 3/1998 | Ueno et al. | 52/19 |
| 5,953,866 | A * | 9/1999 | Poole | 52/169.6 |
| 5,974,743 | A * | 11/1999 | Vaia | 52/169.6 |
| 6,039,201 | A * | 3/2000 | Kesterman et al. | 220/484 |
| 6,161,345 | A | 12/2000 | Hope et al. | |
| 6,308,471 | B1 | 10/2001 | Raynor | |
| 6,393,776 | B1 * | 5/2002 | Waller et al. | 52/169.6 |
| 6,415,558 | B1 | 7/2002 | Cherry | |
| 6,981,347 | B1 * | 1/2006 | Walburger | 52/79.1 |
| 2003/0167708 | A1 * | 9/2003 | Shaw et al. | 52/169.6 |
| 2003/0172597 | A1 * | 9/2003 | Folkema | 52/23 |

* cited by examiner

*Primary Examiner*—Richard E. Chilcot, Jr.
*Assistant Examiner*—Anthony N Bartosik
(74) *Attorney, Agent, or Firm*—Edward L. White

(57) ABSTRACT

An improved shelter of the type having a front wall, a back wall, two opposing side walls, a bottom and a top defining a substantially rectangular box with an opening defined in the top, a flat lid adapted to cover the opening, a roller means for alternately rolling the lid to expose or close the open top, the improvement comprising: substantially, the entire top of the box defining an opening; the lid adapted to be substantially flush with the surrounding ground level in a closed position; and a roller means for allowing the lid to slide above the ground level, exposing more than half of the top when in an open position. The shelter alternatively including stairs rotatably affixed to the front wall and a stair support means releaseably supporting the stair in position to be used as a stepping entrance into the shelter, whereby the stair can be rotated against the front wall when not in use or rotated and fixed in place by the stair support means to serve as a stepping surface.

9 Claims, 12 Drawing Sheets

IN-GROUND SHELTER

CROSS REFERENCES TO RELATED APPLICATIONS

None.

BACKGROUND OF THE INVENTION a. Field of the Invention

The present invention relates to the field of shelters. More particularly, the present invention relates to in-ground shelters which either can be installed in new construction or can be retrofit, for example, in a garage in an existing residence. The present invention includes an improved sliding access door which allows for easier entrance and exit from the shelter than the prior art because the present invention has a larger opening and is unobtrusive because of its profile, substantially flush with the surrounding ground/floor level.

b. Description of the Prior Art

The idea of a shelter from dangerous forces such as tornadoes, hurricanes or bombs has been around for decades. See, for example, Pierson, U.S. Pat. No. 3,114,153 for a Combination Shelter and Swimming Pool. While less than optimally functional (what, for example, does one do about the water in the pool if one needs to use the shelter?), Pierson illustrates that the idea of an in-ground shelter is not new. Presumably, Pierson was focusing his efforts as a shelter that might protect a user from the threat of Soviet nuclear attack. Before Pierson, many people installed simple cellars primarily for food storage, but also for protection from storms. Entrance to these early shelters was usually accomplished by a hinged door.

More relevant to the present invention are Hope et al., U.S. Pat. No. 6,161,345, and Poole, U.S. Pat. No. 5,953,866. Hope et al., claimed a "tornado shelter," and Poole claimed a "storm shelter." Both are for a shelter which is designed to be installed below ground, and which has a sliding substantially flat access door near ground level to allow ingress and egress. The door in Poole, which is the patent closest to the present invention, appears to covers approximately one-third of the top of the shelter. The door sits on rollers, and rolls downwardly and inwardly to open. That is, it rolls down underneath of the rest of the shelter's top. This method of operation means that by rolling downwardly, it takes room out of an already cramped shelter, and by rolling under the lid, the size of the access door is limited because it must be smaller than the remaining portion of the top of the shelter under which it rolls. The opening in Hope's shelter cannot be larger than approximately one-half of the surface area of the top of the shelter. While an opening of this size may be sufficient for some purposes, for the disabled or for very large persons, it may be difficult to enter a shelter with such a limited opening size. Further, those who are claustrophobic would find such a shelter even more constricting knowing that the opening through which they have to pass out of the shelter is so small. Also, to the extent objects are to be taken into or stored in the shelter, the smaller opening makes putting them in or taking them out more difficult.

Poole claims a similar device, but the description in Poole and the drawings are much more limited. The opening covers about half of the top of the shelter area or less. There is no description in Poole about how the lid, as shown open in FIG. 6, is prevented from tipping over as it is opened. The force of gravity would, as shown in FIGS. 5 and 6 of Poole, force the leading edge of the lid to tip under its own weight. There is no structure shown or described in Poole which would prevent this from happening. Further, the Poole lid is well above ground level, which may prevent a vehicle from parking above the shelter if installed in a garage and which would also present a tripping hazard.

Ueno et al., U.S. Pat. No. 5,732,512 shows a manhole opening structure. While it is not directly related to the present art, it does allow access to an under-ground cavity, and it does have a substantially flat lid which opens to allow access. The problem with Ueno is that the lid slides on the ground. As the lid slides, it may slide over an uneven ground surface surrounding it, and the sliding would be less than uniform, especially given the debris that might gather around the shelter as a result of the storm. It would be very difficult to open a device such as one described by Ueno in a storm shelter context. Therefore, while Ueno is instructive, it does not show or describe the features of the claimed invention.

SUMMARY OF THE INVENTION

An improved in-ground shelter of the type having a front wall, a back wall, two opposing side walls, a bottom and a top. These walls, the bottom and the top define a substantially rectangular box with an opening defined in the top thereof, a flat lid adapted to cover the opening, and a roller means for alternately rolling the lid to expose or close the open top. The improvement of the present invention comprises, inter alia: (a) substantially the entire top of the box defining an exposable opening, i.e, an opening that can be uncovered in common usage; (b) the lid adapted to be substantially flush with the surrounding ground level in a closed position; and (c) a roller means for allowing the lid to slide above the ground level, exposing more than half of the open top.

Securing means for maintaining the lid in place in a closed position are provided. Securing means may include at least one set of cooperating L-brackets, which, when the lid is in a closed position, serve to resist the lifting forces that might be exerted on the lid by a tornado, hurricane, or the like, so as to maintain the lid in a closed position. Securing means may also include at least one chain cooperating with a chain receiver bracket, again serving the function of maintaining the lid in a closed position.

The roller means may comprise a track affixed to each of the side walls near the open top and parallel thereto, and at least one upper track roller disposed between the lid and each track for rollingly supporting the lid on the track. Further, the roller means may comprise a support means for supporting a leading edge of the lid as it slides above the surrounding ground level. The support means may comprise a rail roller adjacent to the back wall and disposed between the lid and the track and a lower track roller attached to the lid near the trailing edge, the lower track roller engaging a lower track surface, whereby the lid is supported above the ground by cooperative action between the lower track roller and the rail roller. The support means may further comprise a rail affixed to the underside of the lid between the rail roller and the lid, the rail having a sloped section near the leading edge, whereby when the leading edge moves away from the back wall, the lid is displaced upwardly by the sloped section operating against the rail roller, the upward displacement providing additional clearance for the lid as it passes over the ground surface. The side walls may have an inwardly tapered section near the open top, whereby the size and weight of the lid are reduced and cars with smaller wheel bases are able to park above the lid without having to drive thereon. A lock means may be provided for externally securing the lid in place to prevent accidental or unauthorized entry by children, or other persons to whom access to the shelter is not desirable.

The shelter may include at least one stair rotatably affixed to the front wall; a stair support means may be included for releaseably supporting the stair in a deployed position to be used for a stepping entrance into the shelter. Where the stair is provided, it may also be desirable to provide a handrail which can be releaseably attached to the stair for convenience of those entering or exiting the shelter or, alternatively stored within the shelter.

Since the invention will often be installed in a garage, with vehicles above it, there is the possibility that during a storm event, a vehicle may be damaged releasing fuel onto or near the shelter. Therefore, a fire prevention or suppression means may be provided within the shelter. The fire prevention or suppression means may comprise a foam-type fire extinguisher for preventing the ignition of fuels that may be present or for fighting fires that may occur.

There have thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. Additional benefits and advantages of the present invention will become apparent in those skilled in the art to which the present invention relates from the subsequent description of the preferred embodiment and the appended claims, taken in conjunction with the accompanying drawings. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application which is measured by the claims, nor is it intended to be limiting as to the scope of the invention in any way.

BRIEF DESCRIPTION OF THE DRAWINGS

The invention will now be described in greater detail with reference to the drawings, wherein:

FIG. 6 is a sectional view along line 6-6 shown in FIG. 3.

FIGS. 9A, 9B and 9C show the interaction of the rail roller with the sloped section of the rail so as to allow the lid to roll over the surrounding ground level into an open position and to return to a substantially flush level in a closed position. FIG. 9A shows the closed position; FIG. 9B shows the lid in a midway position being raised by the operation of the rail roller and sloped portion; and FIG. 9C shows the lid in an open elevated posture.

FIG. 12A shows the rail roller in contact with the lid, as in a closed position; FIG. 12B shows the rail roller in contact with the rail, as in an open position.

DESCRIPTION OF PREFERRED EMBODIMENTS

Figure 1:
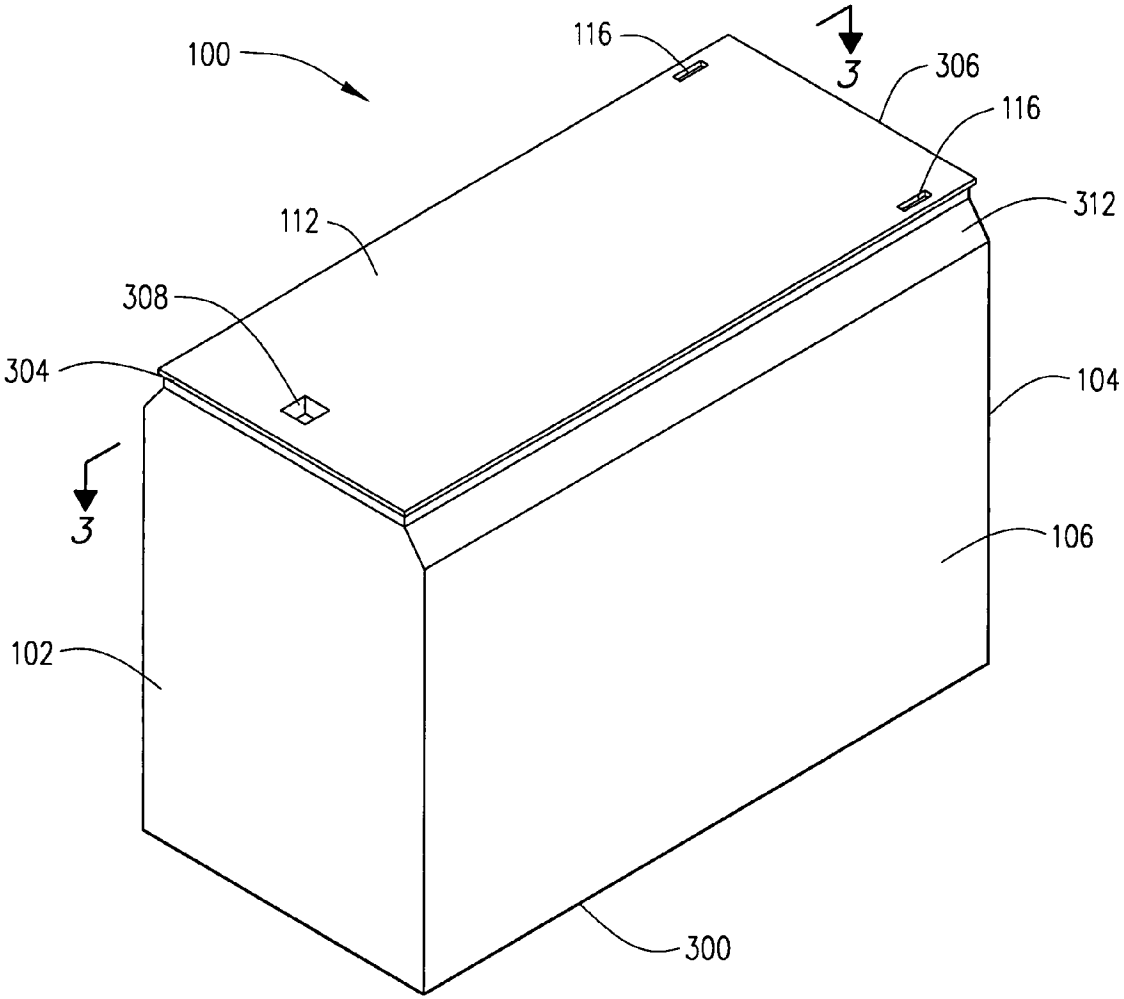
FIG. 1 is a perspective of the shelter with the lid in a closed position.
Figure 2:
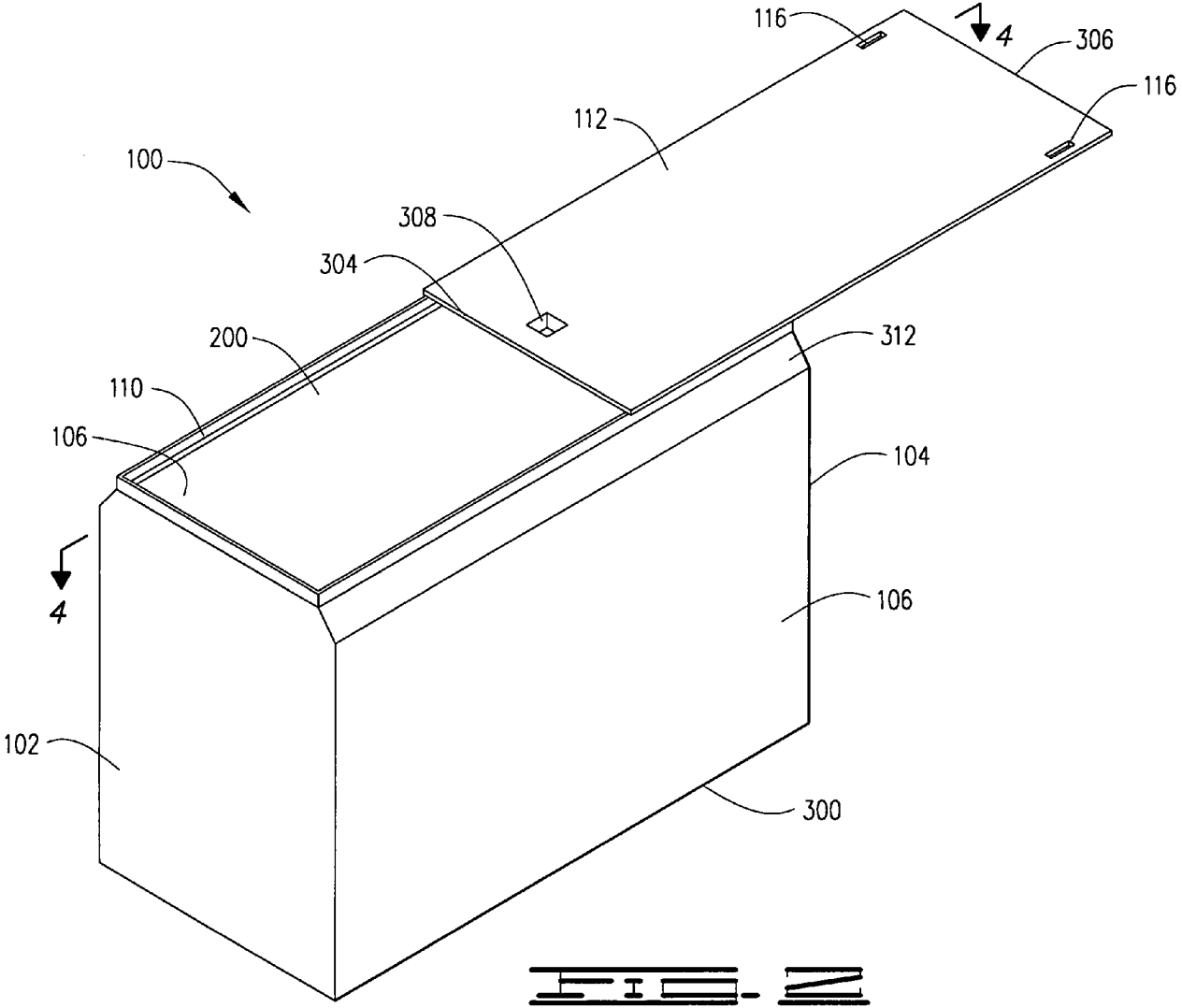
FIG. 2 is a perspective view showing the lid in an open position.

The invention will now be described with reference to the drawings. FIG. 1 shows the present invention in perspective with the lid 112 in a closed position. The shelter 100 has a lid 112, a front wall 102 opposed to a back wall 104, two opposing side walls 106 and a bottom 300. Together, these walls, the lid and the bottom form a substantially rectangular box-like structure. The bottom 300 will preferably be substantially flat. FIG. 2, another perspective view, shows the lid 112 in an open position with the trailing edge 304 more closely adjacent to the back wall 104. In the closed position, the trailing edge 304 of the lid 112 is adjacent to the front wall 102, and the leading edge 306 of the lid 112 is adjacent to the back wall 104.

The side walls 106 are shown with an inwardly tapered section 312 near the open top, whereby the size and weight of the lid are reduced and cars with smaller wheel bases are able to park above the lid without having to drive thereon. If the side walls did not have the tapered section 312, the lid would be wider, thus increasing its weight and, more importantly, its width which might require cars with narrower wheelbases to park thereon, which, though allowable, is undesirable.

Figure 3:
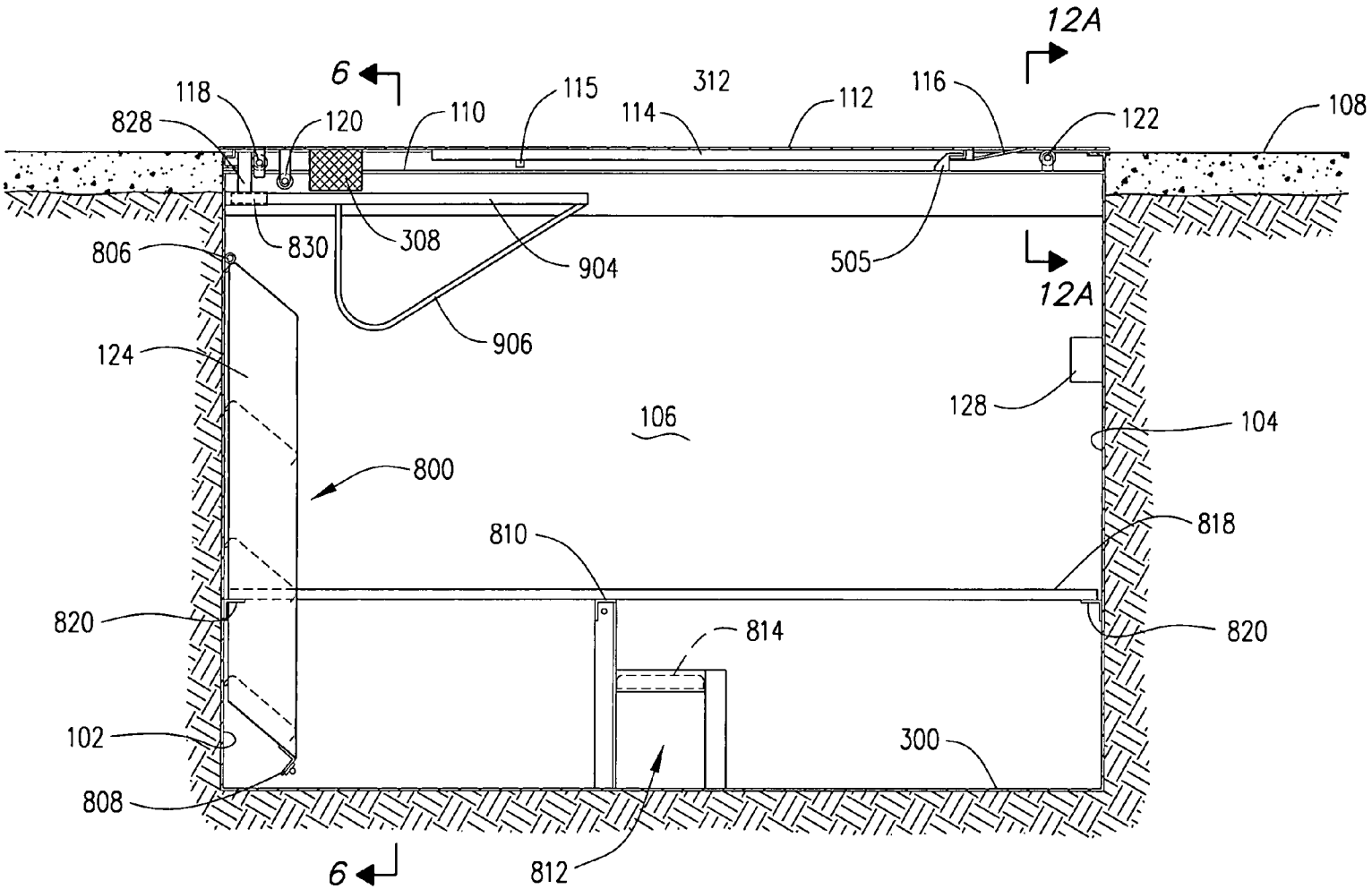
FIG. 3 is a side sectional view along line 3-3 from FIG. 1, with the lid in an closed position and the ladder and handrail in a stored position.

In FIG. 3, the surrounding ground level 108 is shown substantially parallel with the lid 112. The track 110 upon which the lid 112 rolls is shown. Rails 114, provide support and bracing for the lid 112. The rails 114 include a sloped rail section 116 which lifts the lid upwardly so as to facilitate it rolling over the surrounding ground level 108. The upper track roller 118 and the lower track roller 120, are disposed adjacent to the trailing edge 304. The rail roller 122 is affixed to the track 110 near the back wall 104.

Stairs 800 are shown affixed to or at least located adjacent to the frontwall 102. Instead of stairs, a ladder could be provided. Shelters can be provided with any number of entrance means, such as the ladder shown in Hope, fixed stairs as shown in Poole, or deployable stairs, shown in the figures and described below. A step-stool 812 for use in cooperation with the stairs 800 is also shown. See discussion of FIGS. 8-10 for more detail on the stairs 800 and step-stool 812.

Figure 4:
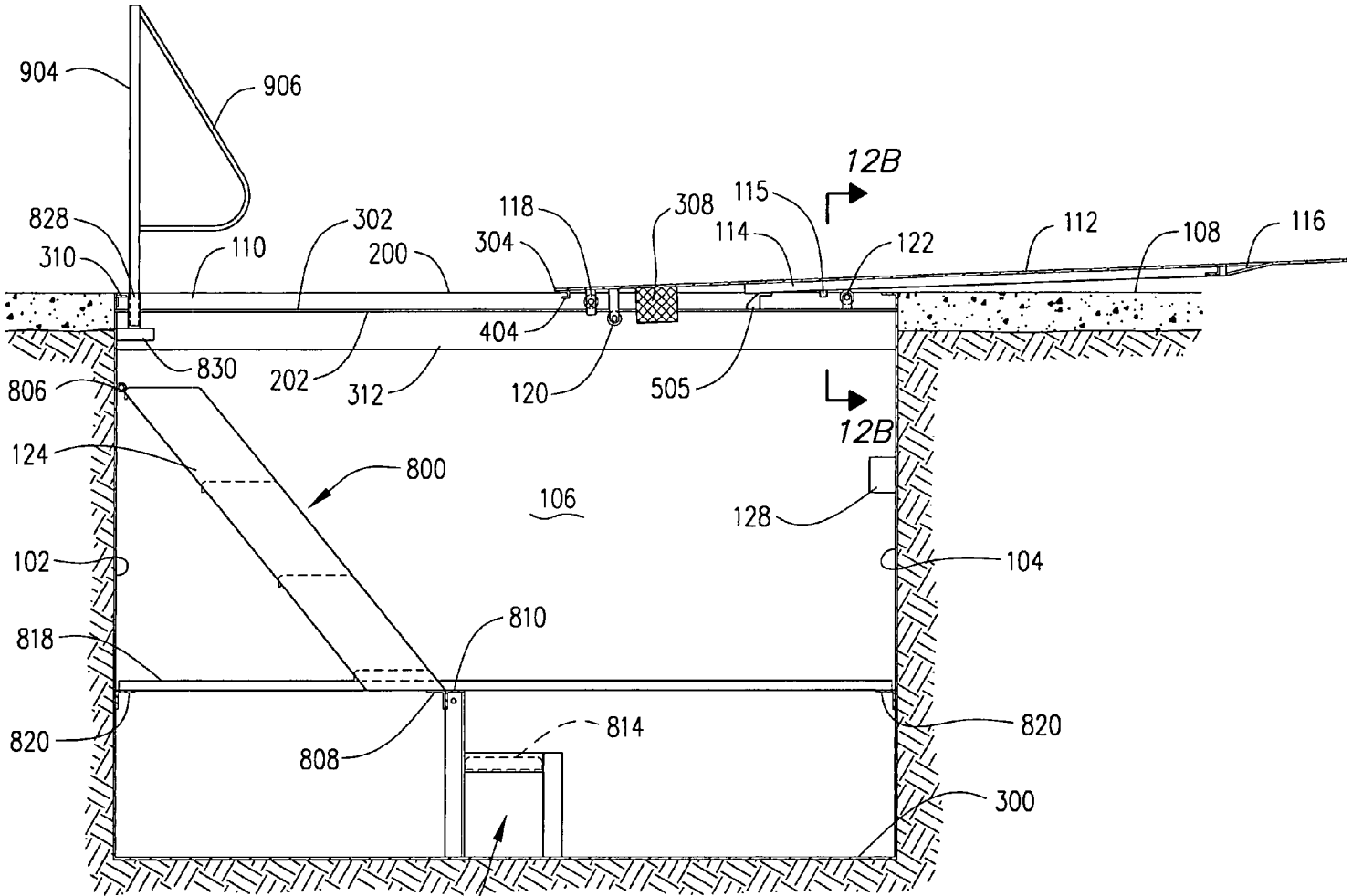
FIG. 4 is a side sectional view along line 4-4 from FIG. 2, with the lid in an open position and the ladder and handrail in a deployed position.
Figure 3:
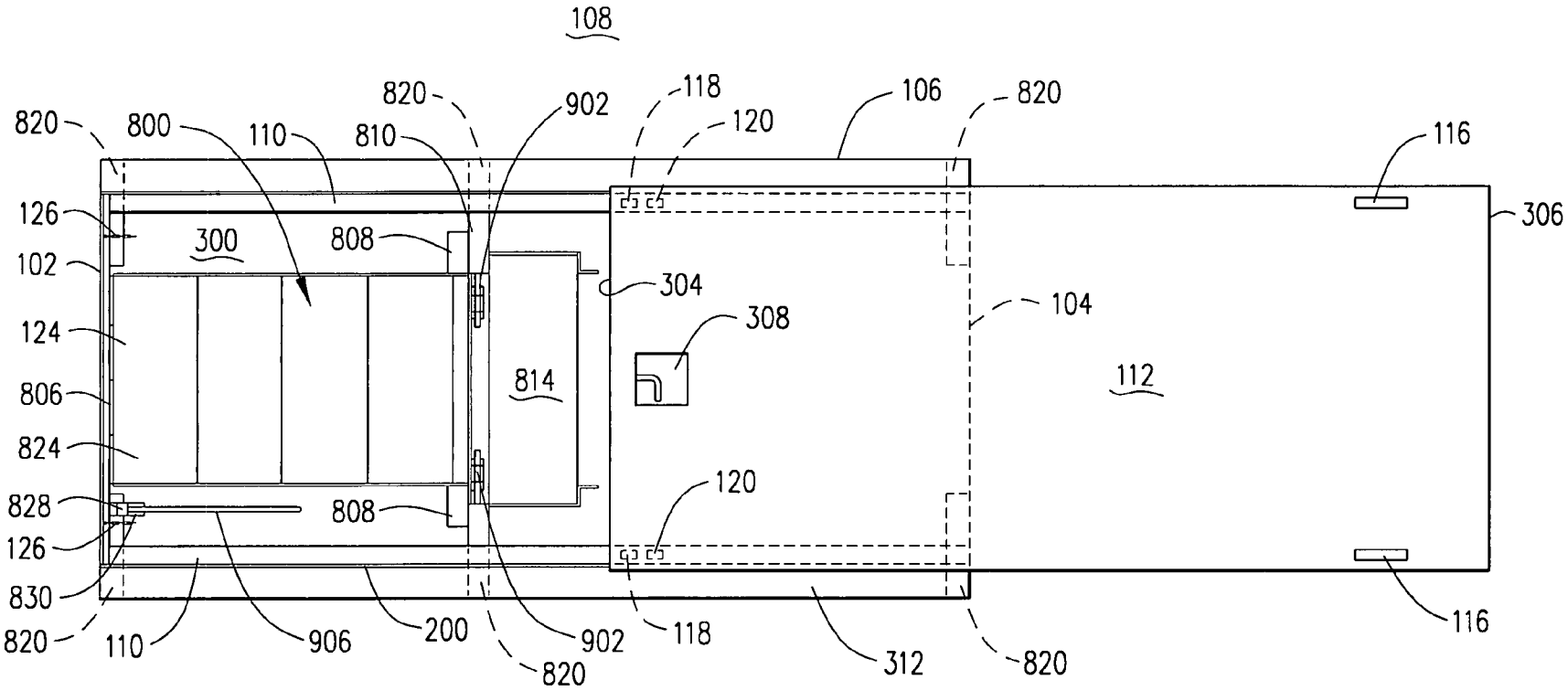
Figure 5:
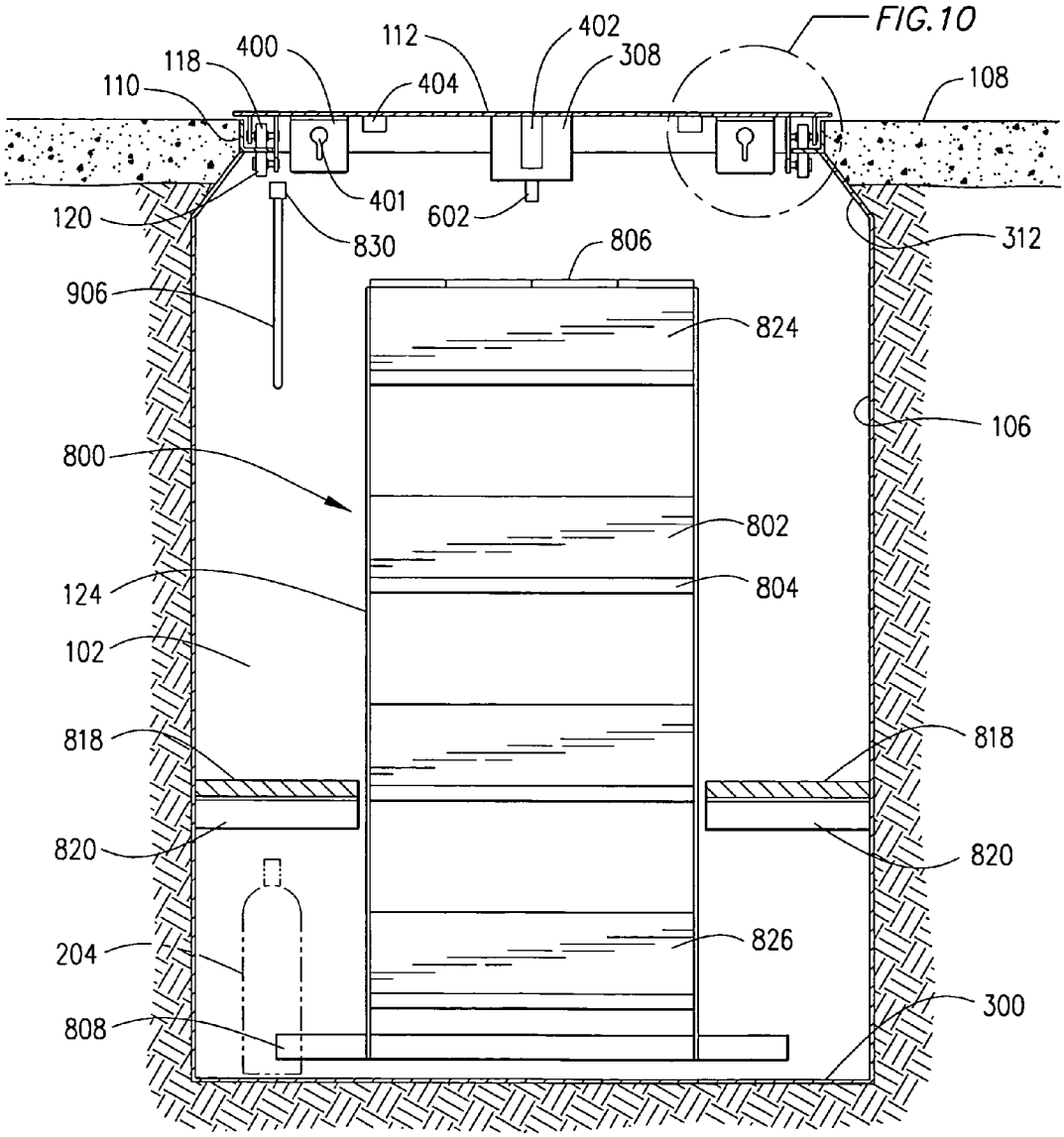
FIG. 5 is a top view with the lid in an open position and the ladder and handrail in a deployed position.

The open top 200 can be seen in FIG. 4, which is a side view with the lid 112 in an open position, and FIG. 5, which is top view. The track 110 has both a lower track surface 202 and an upper track surface 302. The upper and lower track rollers 118 and 120, respectively, and the rail roller 122 cooperate to rollingly hold the lid 112 in position as it passes over the surrounding ground level 108, while moving into an open position. The ladder 800 is shown in a deployed or open position, as is the handrail 906. The upper track surface 302 will be a smooth surface to facilitate rolling of the lid. The trailing edge 304 remains above the bottom 300. The leading edge 306 passes over the ground level 108.

As seen in FIG. 6 (also in FIGS. 10 and 11), the chain receiver 400 defines an elongated hole therein 401 for receiving the a chain 126 so as to secure the lid 112 in place. An outer handle 600 of the movable handle 500 (see also FIGS. 6 and 7). The cooperation of the stairs 800 and the step-stool 812 to create a continuous set of steps for ingress or egress is illustrated. The placement of the upper and lower track rollers, 118, and 120, respectively above and below the track is visible. A fire extinguisher 204 is stored underneath the bench 818. Since the shelter will often be installed in garages, there is the possibility (though not the likelihood), that fuel from an automobile in the garage may leak onto the shelter during a storm or similar event. In that circumstance, it may be desirable to have a fire extinguisher available. Preferably, the extinguisher would be of a type appropriate for fires of flammable liquids, for example, a foam-type extinguisher. It would be undesirable to use a carbon dioxide-type extinguisher because it could deprive occupants of oxygen.

Figure 7:
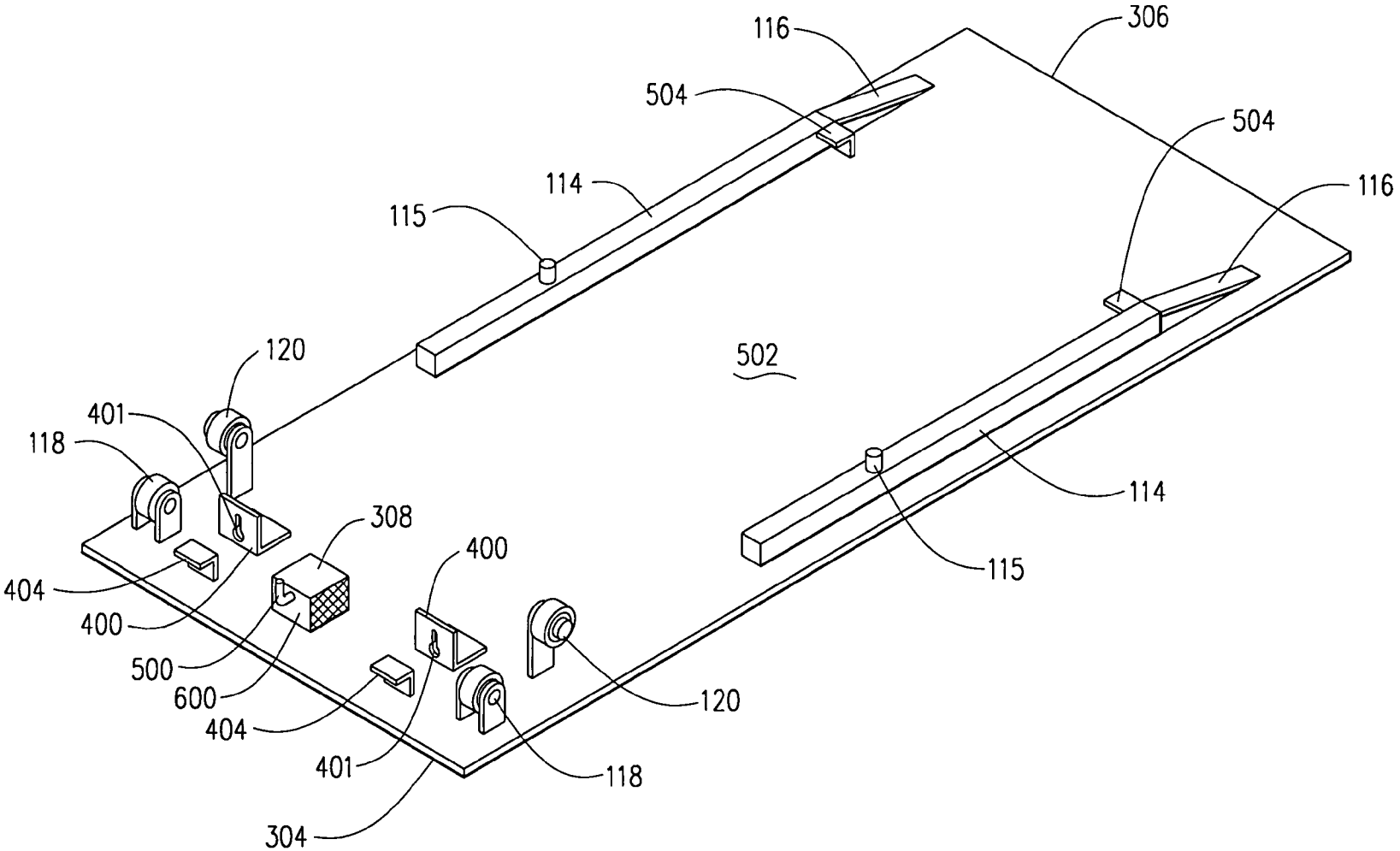
FIG. 7 is a perspective view of an underside of the lid showing the hardware attached thereto.

FIG. 7 shows the lids underside or bottom of the lid 502. The chain receiver brackets 400 are adjacent to the trailing edge L-brackets 404, which engage frontwall L-brackets 310 that can be seen in FIG. 4. Cooperatively, the frontwall and trailing edge L-brackets serve to prevent the lifting forces of a storm from raising the lid up when it is in a closed position. The same function is served by the cooperative action of the sidewall L-brackets 504 and the rail L-bracket 505. The relative attachment points for the upper and lower track rollers 118 and 120, respectively are shown. The rails 114, including the sloped section 116, serve both to stiffen the lid and to raise it somewhat upon opening so that it passes smoothly over the surrounding ground. Affixed to the each rail 114 is a stopper 115 which engages the rail roller 122 when the lid 112 reaches a fully open position, acting to prevent the lid from going past the fully open position. Attached to the recessed box 308 is a fixed handle 402 on one side and a moveable handle 500 on the other side for preventing unauthorized access to the shelter.

Figure 8:
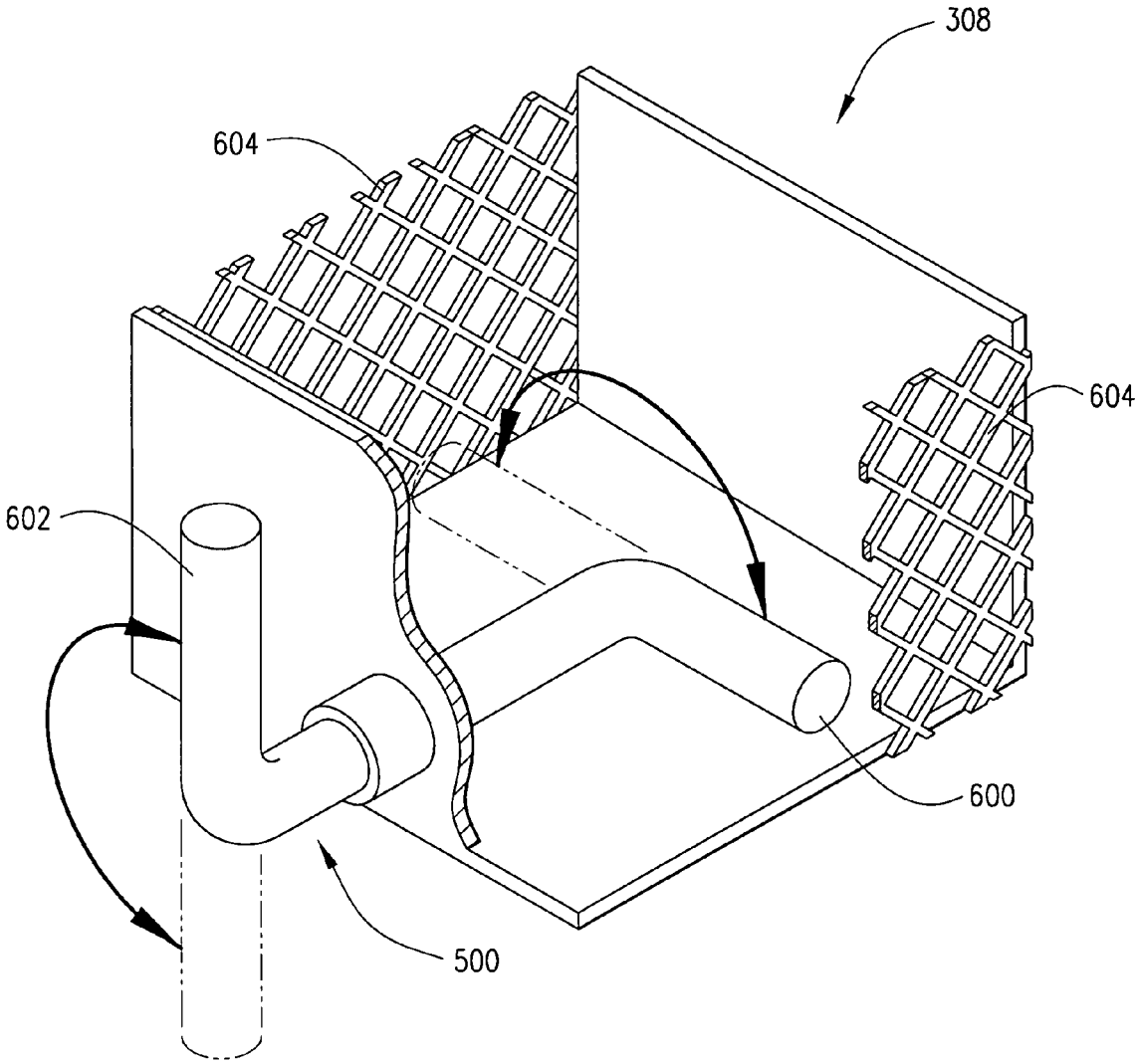
FIG. 8 is detailed sectional perspective view of the recessed box, which contains the removable handle for locking the lid to prevent unauthorized access.
Figure 3A:
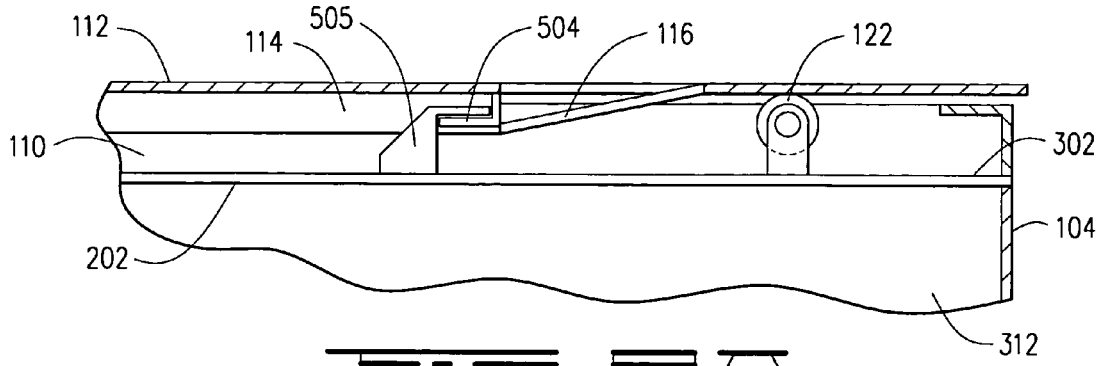
Figure 3B:
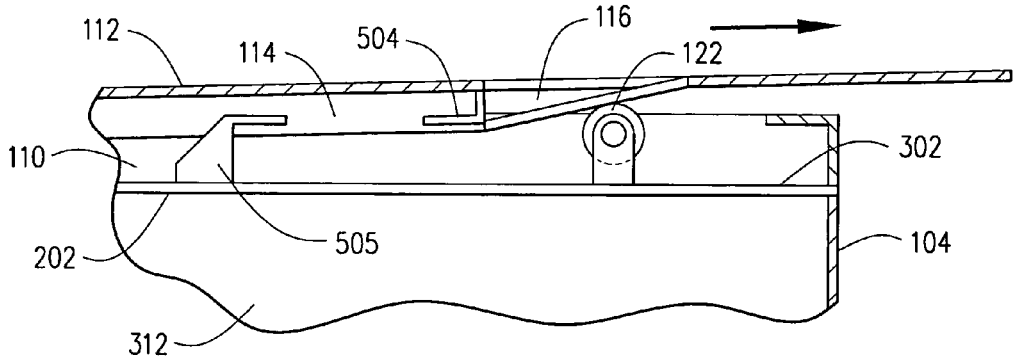
Figure 3C:
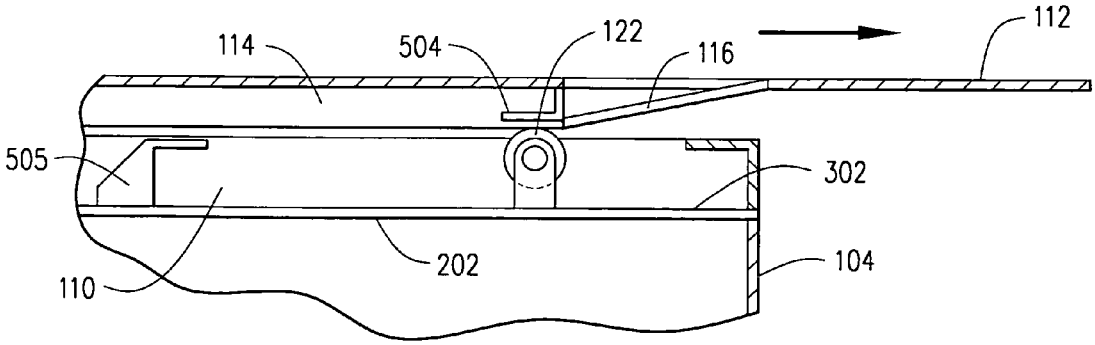

FIG. 8 is a detailed view of the recessed box 308. It includes an outer handle end 600, and inner handle end 602 of the moveable handle 500. The outer handle end 600 can define a hole therein for cooperative use with a lock and hasp to prevent unauthorized access to the shelter. Even when no lock is used, the moveable handle 500 serves to prevent unintentional opening of the lid 112. A vent grate 604 allows for ventilation of the shelter. The grate prevents flying debris caused by storms from entering the shelter but allows air flow.

Figure 12A:
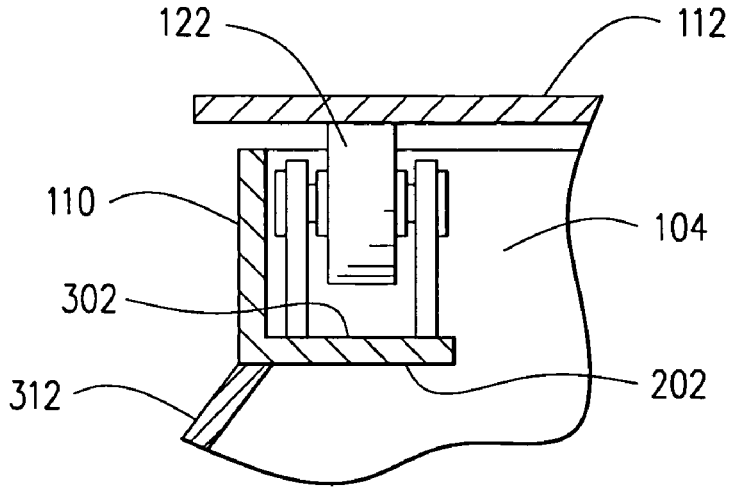
FIGS. 12A and 12B are detailed views along line 12-12 from FIG. 3, showing the rail roller in contact with a lower surface of the lid and the rail respectively.
Figure 12B:
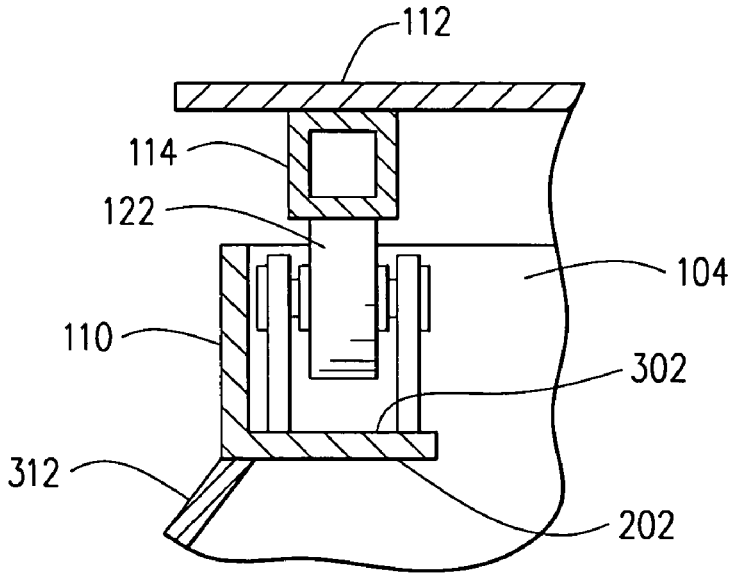

FIGS. 9A-9C show the cooperative action of the rail roller 122 and the sloped section 116 to lift the lid 112 as it slides open so as to allow it to rollingly pass over the surrounding ground level 108. FIG. 9A shows the lid 112 in a closed position, and the rail roller 122 in direct contact with the lid. In a closed position, the side L-bracket 504 cooperates with the rail L-bracket 505 to prevent the lid 112 from being lifted upward by the vacuum force of a tornado, for example. In FIG. 9B, the lid is between open and closed states. The rail roller 122 is in contact with the sloped section 116 which lifts the lid upwardly (if it is being opened) or lowers it (if being closed). As the lid moves away from a closed state, the side L-bracket 504 disengages the rail bracket 505, allowing the lid to be raised up. Finally, in FIG. 9C, the lid is at its highest position with the rail roller 122 in contact with the rail 114. The position of the rail roller vis-a-vis the rail and the lid is further illustrated in FIG. 12A (lid in closed position) and 12B (lid in an open position).

Figure 10:
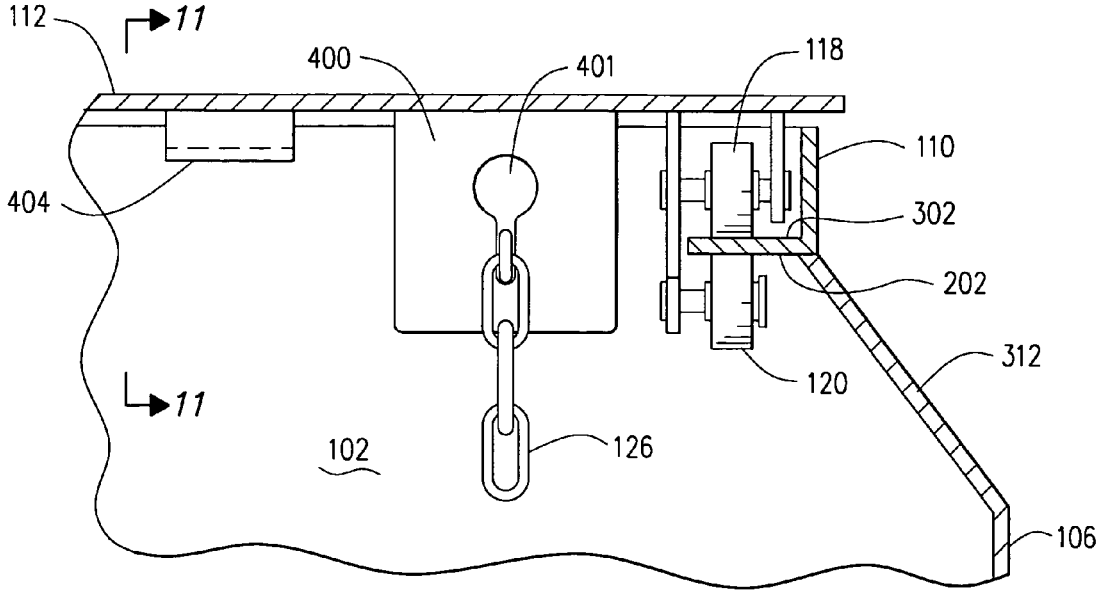
FIG. 10 is a detailed illustration of the mechanisms highlighted in FIG. 6, specifically, the cooperative action of the upper and lower lid rollers as well as the cooperative action of the chain receiver and chain.
Figure 11:
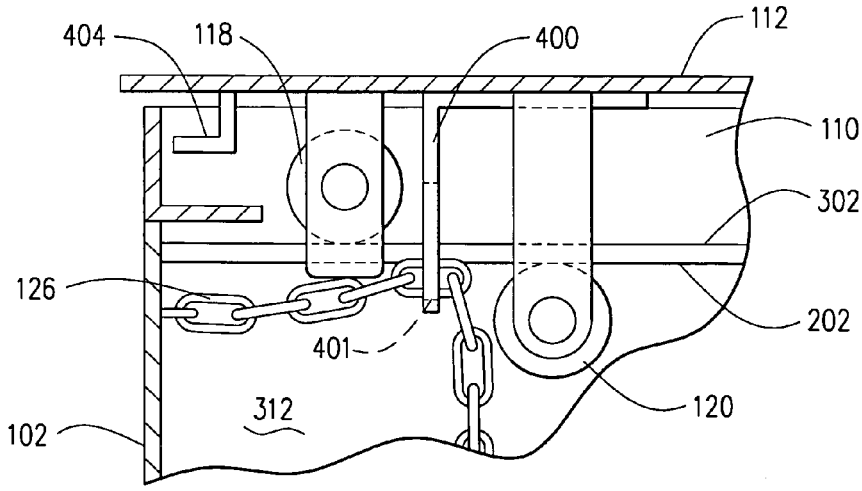
FIG. 11 is detailed illustration of the same mechanisms from FIG. 10, but shown from a side view along the line 11-11.

FIGS. 10 and 11 show how the chain receiver 400 and the hole defined therein 401 receive the chain 126. When the chain is inserted in the hole, the two cooperate to hold the lid in a closed position. The chain 126 can only be engaged with or disengaged from the hole 401 by a person inside the shelter, and this fact prevents the closure mechanism from being accidentally engaged, in effect, locking you out of the shelter.

In case the lid 112 becomes obstructed during a storm event, a back wall emergency hook 128, shown in FIGS. 3 and 4, can be provided. The back wall emergency hook 128 and the handle 402 can, by using a device commonly referred to as a come-along, serve to provide additional force to open the lid 112. The come-along is a ratchet-based device which has a handle for applying a ratcheting force and a cable that can be tightened thereby. The handle operates the ratchet mechanism, tightening the cable. The handle gives substantial leverage which allows a user to exert substantial pulling force via the cable. A first terminal end of the cable may be attached to the back wall emergency hook 128 and a second terminal end of the cable to the handle 402, and the pulling force exerted by the come-along thereby serves to open the lid 112.

Figure 13:
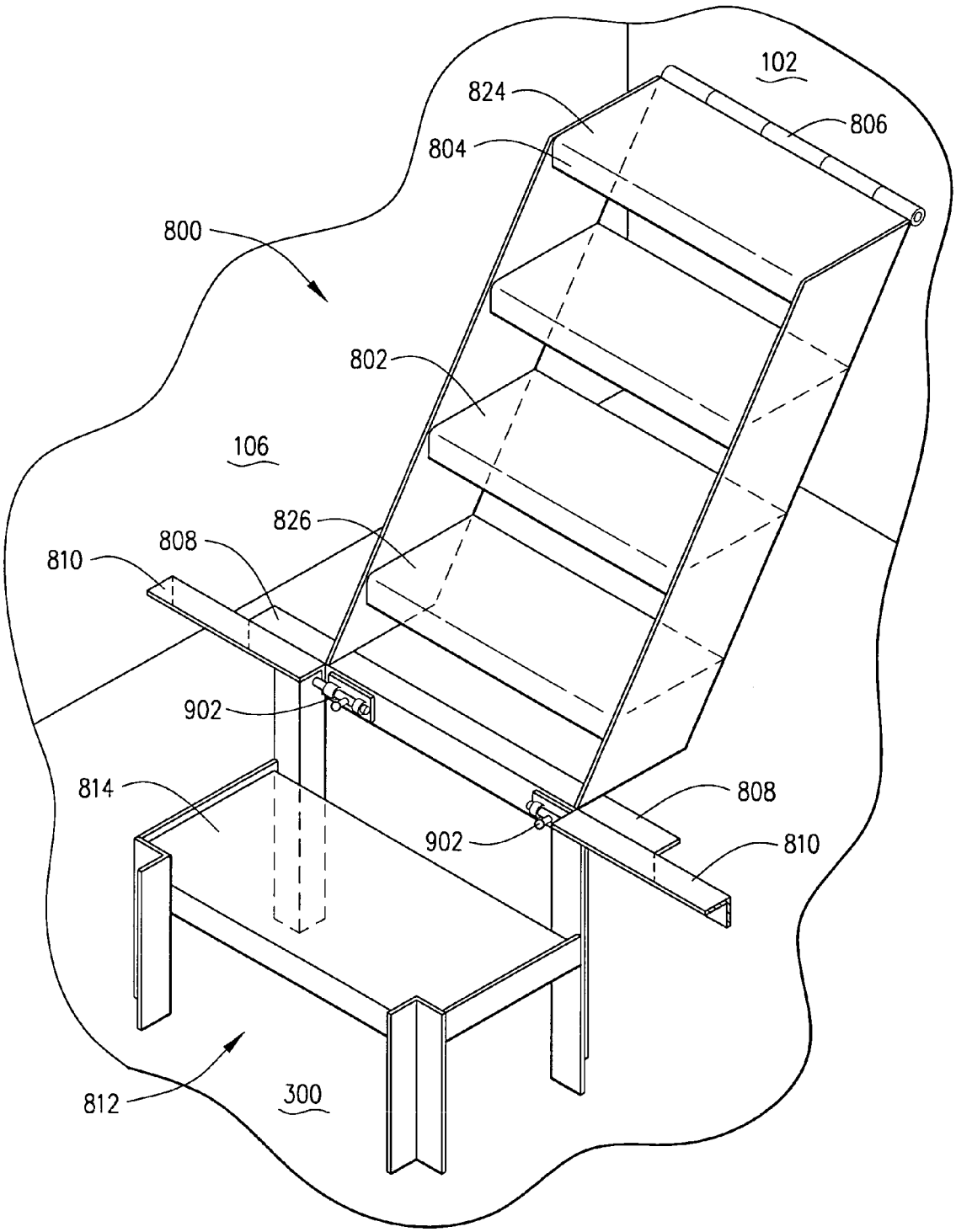
FIG. 13 is a perspective view of the stairs and step-stool in a deployed position.

FIG. 13 shows stairs 800, which can be incorporated in the shelter 100 to facilitate ingress and egress. The stairs 800 have at least one tread 802 and face 804. The stairs are attached to the frontwall 102 via a hinge 806. The stairs 800 have at least one upper stair 824 and at least one lower stair 826. If there is only one stair, the single stair will be both the upper and the lower stair. A stair support bracket 808 is attached to a lower portion of the face 804 of the lower stair 826. The stair support bracket 808 can cooperate with the seat support bracket 810 affixed to the side walls 106. A aligned holes are defined in both the stair support bracket 808 and the seat support bracket 810 for receiving a stair pin 902. The stair pin 902 serves to hold the stairs 800 in place to serve as stepping surfaces for entering or exiting the shelter.

Alternatively, or in addition to stairs, a step-stool 812 may also be provided. The step-stool 812 preferably has at least one top step 814, and may also have a second step 816. The step-stool 812 may be stored under a bench 818 along the side wall 102. A bench 818 is supported by a bench brace 820. Preferably, the top step 814 is at a height such that it is just below the bottom of the lower stair 826, such that by cooperative action, the stairs 800 and the step-stool 812 provide a continuous set of steps.

At least one handrail receiver 828 may also be disposed on the stairs 800 for receiving baluster 904 to support a handrail 906. The baluster 904 and handrail 906 are shown in FIG. 3 in a stored position and in FIG. 4 in an open or deployed position. The balusters 904 are adapted to be slidingly received within the handrail receiver 828 in a deployed position or within handrail receiver 830 in a stored position. Thus, the handrail 906 can be removably inserted into one of two positions within the handrail receiver 828 (deployed position) or 830 (stored position) to facilitate ingress or egress.

While the invention has been shown, illustrated, described and disclosed in terms of embodiments or modifications which it is assumed, the scope of the invention should not be deemed to be limited by the precise embodiment or modification therein shown, illustrated, described or disclosed. Such other embodiments or modifications are intended to be reserved especially as they fall within the scope of the claims herein appended.

Thus having described the field of the invention, the prior art, the attached drawings, the summary of the invention, and the detailed description of the preferred embodiments, We claim:

1. An underground shelter of the type having a front wall, a back wall, two opposing side walls, a bottom and a top defining a substantially rectangular box with an opening defined in the top, a flat lid adapted to cover the opening, a roller means for alternately rolling the lid to expose or close the open top, the improvement comprising:

a. substantially, the entire top of the box defining an opening:
b. the lid adapted to be substantially flush with the surrounding ground level in a closed position: and
c. a roller means comprising:
  i. a track affixed to each of the side walls near the open top and parallel thereto,
  ii. at least one upper track roller disposed between the lid and each track, each upper track roller rollingly supporting the lid as it moves relative to the track,
  iii. a support means for supporting a leading edge of the lid as it slides over the surrounding ground level, the support means having:
    (1) at least one rail roller adjacent to the back wall disposed between the lid and the track,
    (2) a lower track roller attached to the lid near the trailing edge, the lower track roller engaging a lower track surface,
    (3) at least one rail affixed to the underside of the lid between the rail roller and the lid, each rail having a sloped section near the leading edge of the lid, whereby when the leading edge moves away from the back wall, the lid is displaced upwardly by operation of the sloped section against the rail roller, providing additional clearance for the lid as it passes over the ground surface.

2. The shelter of claim 1, the side walls having an inwardly sloped section near the open top whereby the size and weight of the lid are reduced, and cars with smaller wheel bases are able to park over the lid without having to drive thereon.

3. The shelter of claim 1 further including a fire prevention means disposed within the shelter.

4. The fire prevention means of claim 1 comprising a foam-type fire extinguisher for preventing ignition of fuels.

5. The shelter of claim 1 further including a lock means for externally securing the lid in place to prevent unauthorized entry into the shelter.

6. The shelter of claim 1 further comprising:

a. at least one stair rotatably affixed to the front wall;
b. a stair support means releaseably supporting the stair in position to be used as a stepping entrance into the shelter, whereby the stair can be rotated against the front wall when not in use or rotated and fixed in place by the stair support means to serve as a stepping surface.

7. The shelter of claim 6, further comprising a step stool provided within the shelter adapted to be placed under the stair, when it is fixed in place by the stair support means, to provide an additional stepping surface whereby entrance or exit from the shelter is further facilitated.

8. An underground shelter of the type having a front wall, a back wall, two opposing side walls, a bottom and a top defining a substantially rectangular box with an opening defined in the top, a flat lid adapted to cover the opening, a roller means for alternately rolling the lid to expose or close the open top, the improvement comprising:

a. substantially, the entire top of the box defining an opening;
b. the lid adapted to be substantially flush with the surrounding ground level in a closed position;
c. a roller means for allowing the lid to slide above the ground level, exposing more than half of the top when in an open position, having,
  i. a track affixed to each of the side walls near the open top and parallel thereto and at least one track roller disposed between the lid and each track, each track roller rollingly supporting the lid as it moves relative to the track,
  ii. a rail roller adjacent to the back wall disposed between the lid and the track, a lower track roller attached to the lid near the trailing edge, the lower track roller engaging a lower track surface, whereby the lid is supported above the supported above the cooperative action of the lower track roller and the rail roller, and
  iii. at least one rail affixed to the underside of the lid between the rail roller and the lid, each rail having a sloped section near the leading edge of the lid, whereby when the leading edge moves away from the back wall, the lid is displaced upwardly by the operation of the sloped section against the rail roller, providing additional clearance for the lid as it passes over the ground surface;
d. a securing means, for maintaining the lid in a closed position during a storm event;
e. the sidewalls each having an inwardly sloped section near the open top; and
f. at least one stair rotatably affixed to the front wall cooperating with a stair support means releasably supporting the stair in a position to be used as a stepping entrance into the shelter, whereby, inter alia, the size and weight of the lid are reduced by the inwardly slopping side walls allowing cars with smaller wheelbases to park over the lid without driving thereon and, whereby, the stair can be rotated against the front wall when not in use or rotated and fixed in place by the stair support means to serve as a stepping surface.

9. The shelter of claim 8 further comprising a step stool provided within the shelter adapted to be placed under the stair, when it is fixed in place by the stair support means, to provide an additional stepping surface, whereby entrance or exit from the shelter is further facilitated.

* * * * *